US009499183B2

(12) United States Patent
Di Cairano et al.

(10) Patent No.: US 9,499,183 B2
(45) Date of Patent: Nov. 22, 2016

(54) SYSTEM AND METHOD FOR STOPPING TRAINS USING SIMULTANEOUS PARAMETER ESTIMATION

(71) Applicant: Mitsubishi Electric Research Laboratories, Inc., Cambridge, MA (US)

(72) Inventors: Stefano Di Cairano, Somerville, MA (US); Sohrab Haghighat, San Carlos, CA (US); Yongfang Cheng, Boston, MA (US)

(73) Assignee: Mitsubishi Electric Research Laboratories, Inc., Cambridge, MA (US)

( * ) Notice: Subject to any disclaimer, the term of this patent is extended or adjusted under 35 U.S.C. 154(b) by 0 days.

(21) Appl. No.: 14/628,387

(22) Filed: Feb. 23, 2015

(65) Prior Publication Data

US 2016/0244077 A1 Aug. 25, 2016

(51) Int. Cl.
*B61L 3/02* (2006.01)
*B61L 27/04* (2006.01)

(52) U.S. Cl.
CPC . *B61L 3/02* (2013.01); *B61L 27/04* (2013.01)

(58) Field of Classification Search
CPC ..... B61L 3/02; B61L 27/04
USPC ..... 701/19
See application file for complete search history.

(56) References Cited

U.S. PATENT DOCUMENTS 7,089,093 B2 * 8/2006 Lacote ..... B61L 23/34 246/2 R
8,332,247 B1 * 12/2012 Bailey ..... G06Q 10/06375 705/13
8,478,463 B2 * 7/2013 Knott ..... B61L 3/221 246/167 R
8,832,000 B2 * 9/2014 Jebara ..... G06N 99/005 705/500
8,838,302 B2 * 9/2014 Kumar ..... B60L 15/38 180/14.1
9,221,476 B2 * 12/2015 Breuer ..... B60T 8/1705
2007/0067678 A1 * 3/2007 Hosek ..... G05B 23/0235 714/25
2008/0201027 A1 * 8/2008 Julich ..... B61L 27/0016 701/19
2008/0288147 A1 * 11/2008 Cesario ..... B60T 8/174 701/70
2009/0204355 A1 * 8/2009 Vold ..... G01M 7/025 702/108

(Continued)

OTHER PUBLICATIONS

S. Di Cairano, A. Ulusoy, and S. Haghighat, "Soft-landing control by control invariance and receding horizon control," in American Control Conference (ACC), 2014. IEEE, 2014.

(Continued)

*Primary Examiner* — Atul Trivedi
(74) *Attorney, Agent, or Firm* — Gene Vinokur; Hironori Tsukamoto; James McAleenan

(57) ABSTRACT

A method for stopping a train at a range of predetermined positions, first acquires a measured state of the trains, and then updates, in a parameter estimator, estimates of unknown parameters and a reliability of the unknown parameters, based on a comparison of a predicted state of the train with the measured state of the train. An excitation input sequence reference generator acquires dynamics of the train to determine a sequence of excitation inputs based on a current estimate of system parameters, the measured state of the train, and a set of constraints on an operation of the train. A model predictive controller (MPC) receives a control-oriented cost function, a set of constraints, the sequence of excitation inputs, the estimate of the unknown parameters and the reliability of the estimate of the unknown parameters to determine an input command for a traction-brake actuator of the train.

15 Claims, 7 Drawing Sheets

(56) References Cited

U.S. PATENT DOCUMENTS

| | | | | |
|---|---|---|---|---|
| 2009/0299996 | A1* | 12/2009 | Yu | G06F 17/16 |
| 2012/0271587 | A1* | 10/2012 | Shibuya | G05B 23/0229 702/127 |
| 2013/0116937 | A1* | 5/2013 | Calhoun | G01M 13/028 702/35 |
| 2014/0180573 | A1* | 6/2014 | Rhea | B60T 13/665 701/411 |
| 2014/0358339 | A1* | 12/2014 | Cooper | B61L 3/006 701/20 |
| 2015/0008293 | A1* | 1/2015 | Hatazaki | B61L 27/0038 246/30 |
| 2015/0375764 | A1* | 12/2015 | Rajendran | B61L 15/0027 701/2 |

OTHER PUBLICATIONS

H. Genceli and M. Nikolaou, "New approach to constrained predictive control with simultaneous model identification," AIChE Journal, vol. 42, No. 10, pp. 2857-2868, 1996.

G. Marafioti, R. Bitmead, and M. Hovd, "Persistently exciting model predictive control using fir models," in International Conference Cybernetics and Informatics, No. 2009, 2010, pp. 1-10.

J. Rathousky and V. Havlena, "MPC-based approximate dual controller by information matrix maximization," International Journal of Adaptive Control and Signal Processing, vol. 27, No. 11, pp. 974-999, 2013.

T. A. N. Heirung, B. E. Ydstie, and B. Foss, "An MPC approach to dual control," in 10th International Symposium on Dynamics and Control of Process Systems (DYCOPS), Mumbai, India, 2013.

T. A. N. Heirung, B. E. Ydstie, and B. Foss, "An adaptive model predictive dual controller," in Adaptation and Learning in Control and Signal Processing, vol. 11, No. 1, 2013, pp. 62-67.

A. Weiss and S. Di Cairano, "Robust dual control MPC with guaranteed constraint satisfaction," in Proceedings of IEEE Conference on Decision and Control, Los Angeles, CA, Dec. 2014.

M. S. Lobo and S. Boyd, "Policies for simultaneous estimation and optimization," in Proceedings of the American Control Conference, San Diego, CA, Jun. 1999.

K. Mohan and M. Fazel, "Iterative reweighted algorithms for matrix rank minimization," The Journal of Machine Learning Research, vol. 13, No. 1, pp. 3441-3473, 2012.

* cited by examiner

SYSTEM AND METHOD FOR STOPPING TRAINS USING SIMULTANEOUS PARAMETER ESTIMATION

RELATED APPLICATIONS

This application is related to U.S. patent application Ser. No. 14/285,811, "Automatic Train Stop Control System," filed on May 23, 2014 by Di Cairano et al., incorporated herein by reference. There, a train is stopped at a predetermined position by constraining a velocity of the train to form a feasible area for a state of the train during movement.

FIELD OF THE INVENTION

This invention relates generally stopping a train automatically at a predetermined range of positions, and more particularly to dual control where an identification and a control of an uncertain system is performed concurrently.

BACKGROUND OF THE INVENTION

A Train Automatic Stopping Controller (TASC) is an integral part of an Automatic Train Operation (ATO) system. The TASC performs automatic braking to stop a train at a predetermined range of positions. ATO systems are of particularly importance for train systems where train doors need to be aligned with platform doors, see the related Application, and Di Cairano et al., "Soft-landing control by control invariance and receding horizon control," American Control Conference (ACC), pp. 784-789, 2014.

However, the transient performance of the train, i.e., the trajectory to the predetermined position, can be adversely affected by uncertainties in dynamic constraints used to model the train. These uncertainties can be attributed to the train mass, brake actuators time constants, and track friction. In many applications, estimating the uncertainties ahead of time (offline) is not possible due to numerous factors, such as expensive operational downtime, the time-consuming nature of the task, and the fact that certain parameters, such as mass and track friction, vary during operation of the train.

Therefore, the parameter estimation should be performed online (in real-time) and in a closed-loop, that is, while the ATO system operates. Major challenges for closed-loop estimation of dynamic systems include conflicting objectives of the control problem versus the parameter estimation, also called identification or learning, problem.

The control objective is to regulate a dynamic system behavior by rejecting the input and output disturbances, and to satisfy the dynamic system constraints. The identification objective is to determine the actual value of the dynamic system parameters, which is performed by comparing the actual behavior with the expected behavior of the dynamic system. That amounts to analyze how the system reacts to the disturbances.

Hence, the action of the control that cancels the effects of the disturbances makes the identification more difficult. On the other hand, letting the disturbances act uncontrolled to excite the dynamic system, which improve parameters estimation, makes a subsequent application of the control more difficult, because the disturbances may have significantly changed the behavior of the system from the desired behavior, and recovery may be impossible.

For instance, the TASC may compensate for the uncertain parameters such as friction and mass by actions of traction and brakes, so that the train stops precisely at the desired location regardless of the correct estimation of the train parameter. Thus, the dynamic system representing the train behaves closely to what expected and the estimation algorithm does not see major difference between the desired behavior and the actual behavior of the train. Hence, it is difficult for the estimation algorithm to estimate the unknown parameters. On the other hand even if the train behavior is close to the desired and the expected behaviors, this may be achieved by a large action of the TASC on brakes and traction, which results in unnecessary energy consumption, and jerk, which compromise ride quality.

On the other hand, letting the train dynamic system operate without control for some time may result in differences between the expected and actual behavior with subsequent good estimation, but when the control is re-engaged the train behavior may be too far from the desired one for the latter to be recovered, or it may cost an excessive amount of energy and jerk to recover.

Finally, in general there is no guarantee that the external disturbances cause enough effect on the train behavior to allow for correct estimation of the parameters, due to their random and uncontrolled nature. That is, it is not guaranteed that the external disturbances persistently excite the train system.

Therefore, it is desired to precisely stop the train within a predetermined range of positions, while estimating the actual train systems parameters to improve performance metrics, such as minimal jerk, energy, or time, by continuously updating the model in real-time. To this end, a system and method is needed for combined estimation and control that achieves:

(i) correct and fast estimation of the system parameters;
(ii) satisfaction of the system constraints including before parameters are correctly estimated; and
(iii) performance criterion optimization.

To assure system parameters estimation, constraint satisfaction, and performance optimization, a model predictive control (MPC) with dual objective can be designed, see the related application Ser. No. 14/285,811, Genceli et al., "New approach to constrained predictive control with simultaneous model identification," AIChE Journal, vol. 42, no. 10, pp. 2857-2868, 1996, Marafioti et al., "Persistently exciting model predictive control using FIR models," International Conference Cybernetics and Informatics, no. 2009, pp. 1-10, 2010, Rathouskỳ et al., "MPC-based approximate dual controller by information matrix maximization," International Journal of Adaptive Control and Signal Processing, vol. 27, no. 11, pp. 974-999, 2013, Heirung et al., "An MPC approach to dual control," 10th International Symposium on Dynamics and Control of Process Systems (DYCOPS), 2013, Heirung et al., "An adaptive model predictive dual controller," Adaptation and Learning in Control and Signal Processing, vol. 11, no. 1, pp. 62-67, 2013, and Weiss et al., "Robust dual control MPC with guaranteed constraint satisfaction," Proceedings of IEEE Conference on Decision and Control, Los Angeles, Calif., December 2014.

In part, the performance of the parameter estimation depends on whether the effect of external actions on the system is sufficiently visible, that is if the system is persistently excited and sufficient information is measured. Thus, for obtaining fast estimation of the system parameters, the action of the dual MPC is selected to trade off the system excitation and control objective optimization. To achieve such desired tradeoff between regulation and identification, an optimization cost function J can be expressed as $$J=J_c+\gamma\psi(U), \tag{1}$$

where J is a linear combination of the control-oriented cost $J_c$, $\psi(U)$ is the residual uncertainty (or conversely the gained information) due to applying a sequence of inputs U, and $\gamma$ is a weighting function of an estimation error that trades off between control and learning objectives. Optimizing cost function (1) subject to system constraints results in an active learning method in which the controller generates inputs to regulate the system, while exciting the system to measure information required for estimating the system parameters.

The weighting function should favor learning over regulation when the estimated value of the unknown parameters is unreliable. As more information is obtained and the estimated value of the unknown parameters becomes reliable, control should be favored over learning, by decreasing the value of function $\gamma$.

Possible definitions $\psi(U)$, i.e., include $$\psi(U)=E_{i=1}^{\Gamma}\mathrm{trace}(P_i), \tag{2a}$$

$$\psi(U)=-\log det(R_\Gamma), \tag{2b}$$

$$\psi(U)=\lambda_{min}(R_\Gamma-R_0), \text{ and} \tag{2c}$$

$$\psi(U)=\Sigma_{i=1}^{v}\exp(-R_{ii}), \tag{2d}$$

where P is unknown parameters covariance matrix, trace returns the sum of the elements on the main diagonal of P, R is an unknown parameters information matrix ($R=P^{-1}$), $\Gamma$ is a learning time horizon, v is the number of unknown parameters, and det and exp represent the determinant and exponent, respectively.

Unfortunately, all measures in (2a-2d) are non-convex in the decision variable U. This turns a conventional convex control problem into a non-convex nonlinear programming problem for which convergence to a global optimum cannot be guaranteed. Furthermore, the weighting function $\gamma$ has a significant effect on the control input U. It is known that the reference generation problem can be converted to a convex problem. For example, Rathouskỳ et al., use an approach based on conducting the reference generation optimization over a $\Gamma$-step learning time horizon, which includes $\Gamma$-1 previous input steps, and uses only a single step in the future.

Heirung et. Al., "An adaptive model predictive dual controller," use $\Sigma_{i=1}^{v}\exp(-R_{ii})$ as a measure of information about the system parameters. That function is used to augment the model predictive cost function. However, to avoid the problems introduced by the non-convexity of that information measure, the minimization of the term is considered over a 1-step learning time horizon. That method also provides the necessary condition for the weighting parameter $\gamma$ to guarantee that the generated reference provides sufficient excitation to learn system parameters. The application of 1-step learning time horizon prevents optimization of the overall system performance, which requires in general a longer time horizon.

Another method provides an approximate solution for simultaneous estimation and control, based on dynamic programming for static linear systems with a quadratic cost function, see Lobo et al., "Policies for simultaneous estimation and optimization," Proceedings of the American Control Conference, June 1999. While the approximate solution can improve the system performance, it cannot be easily applied to dynamic systems, such as ATO systems, and it requires significant computations, which may be too slow or may require too expensive hardware to be executed in ATO.

SUMMARY OF THE INVENTION

The embodiments of the invention provide a system and method for stopping a train at a predetermined position while optimizing certain performance metrics, which require the estimation of the train parameters. The method uses dual control where an identification and control of an uncertain system are performed concurrently.

The method uses a control invariant set to enforce soft landing constraints, and a constrained recursive least squares procedure to estimate the unknown parameters.

An excitation input sequence reference generator generates a reference input sequence that is repeatedly determined to provide the system with sufficient excitation, and thus to improve the estimation of the unknown parameters. The excitation input sequence reference generator computes the reference input sequence by solving a sequence of convex problems that relax a single non-convex problem.

The selection of the command input that optimizes the system performance is performed by solving a constrained finite time horizon optimal control problem with a time horizon greater than 1, where the constraints include the control invariant set constraints. To ensure convergence of the parameter estimates of the unknown parameter, we include an additional term in the cost function of the finite time horizon optimal control problem accounting for the difference between the command input sequence and the reference input sequence.

The finite time horizon optimal control problem is solved in a model predictive control (MPC). Thus, MPC uses the excitation input sequence and current estimates of unknown parameters to determine the system input u(k), command input, which results, for instance, in commands to train traction and brake. Due to the additional term in the cost function minimizing the deviation of the input from the excitation input, the MPC provides the required excitation for improving parameter estimation.

After the input is applied to uncertain train dynamics, the train state information and input information are used in a parameter estimator to update the estimates of the unknown parameters.

DETAILED DESCRIPTION OF THE PREFERRED EMBODIMENTS

Figure 2:
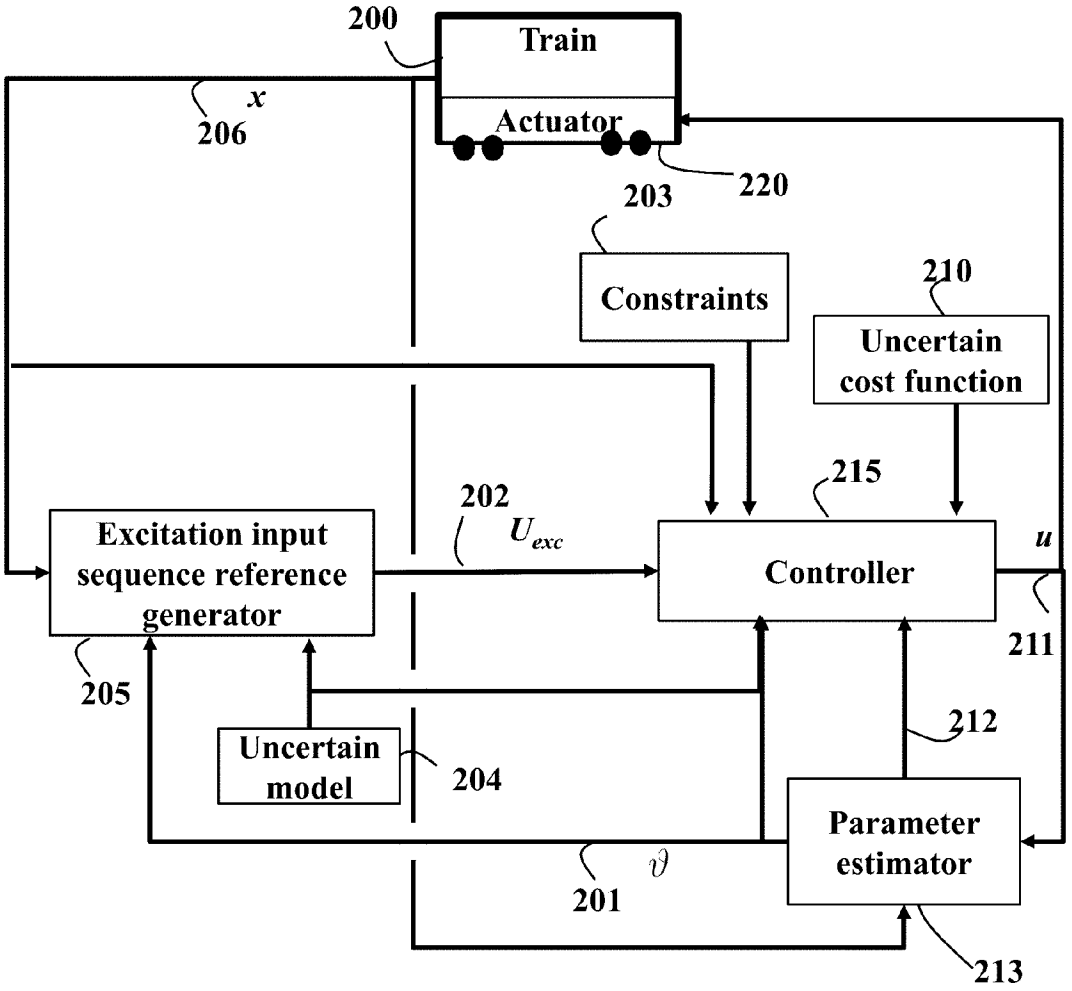
FIG. 2 is a block diagram of a method and system for stopping a train at a predetermined position according to embodiments of the invention.

As shown in FIG. 2, the embodiments of the invention provide a method and system for stopping a train 200 at a predetermined range of positions while optimizing a performance objective, which requires estimation of the actual train dynamics parameters. The method uses a two-step model predictive control (MPC) for dual control.

In the conventional single-step formulation as described in the background section, the learning and control objectives are combined to form an augmented optimization problem, such as the optimization cost function in equation (1).

In the two-step formulation according to embodiments of the invention, the problem of generating the excitation input 202 is solved first. This is followed by the solving the control problem in the controller 215, which is modified to account for the solution of the excitation input generation problem.

Description of the Uncertain Train Dynamics

This invention addresses uncertain train systems that can be represented as a disturbed polytopic linear difference inclusion (dpLDI) system.

The model of the dynamics of the train is $$x(k+1)=A_r x(k)+B_r u(k)+B_w w, \tag{3}$$

where $x \in R^{n_x}$, $u \in R^{n_u}$, $w \in R^{n_w}$ are the state, command input, and the disturbance vectors for the model representing the train dynamics, respectively. The state, command input, and disturbance for the model representing the train dynamics are the same as in the related Application.

As shown in FIG. 2, the command input u 211 is the command sent to a traction-brake actuator 220, such as electric motors, generators, and pneumatic brakes. The matrices A, B are the state and input matrices, which can be represented as a convex combination of a set of state and input matrices ($A_i$, $B_i$), using the unknown parameters $\theta_i$. The disturbance can be expressed as a convex combination of a set of disturbance vectors ($w_i$) using the unknown parameters $\eta_i$.

The details of the procedure for expressing an uncertain system in the form of equation (7) below is described in the related Application, i.e., $$A_r=\Sigma_{i=1}^{l}\theta_i A_i, B_r=\Sigma_{i=1}^{l}\theta_i B_i, w_r=\Sigma_{i=1}^{p}\eta_i w_i, \tag{4}$$

where $\theta_i$ are coefficients of a convex combinations and represents the unknown parameters for the system dynamics, and $\eta_i$ are coefficients of a convex combinations and the unknown parameters for the disturbance vector and satisfy $$\Sigma_{i=1}^{l}\theta_i=1, \theta_i \geq 0, \Sigma_{i=1}^{l}\eta_i=1, \eta_i \geq 0.$$

Because the value of the parameters $\theta_i$, $\eta_i$ is unknown, an estimate of the model is used $$x(k+1)=\hat{A}x(k)+\hat{B}u(k)+B_w\hat{w}, \tag{5}$$

$$\hat{A}=\Sigma_{i=1}^{l}\hat{\theta}_i A_i, \hat{B}=\Sigma_{i=1}^{l}\hat{\theta}_i B_i, \hat{w}=\Sigma_{i=1}^{p}\hat{\eta}_i w_i, \tag{6a}$$

$$\Sigma_{i=1}^{l}\theta_i=1, \theta_i \geq 0, \Sigma_{i=1}^{l}\eta_i=1, \eta_i \geq 0 \tag{6b}$$

where $\hat{\theta}_i$ are estimates of the unknown parameters for the system dynamics, and $\hat{\eta}_i$ are estimates of the unknown parameters for the disturbance vector.

The estimate of the parameters, and hence the estimate of the model, changes as the estimation algorithm obtains more information about the operation of the train.

System Constraints and Soft-Landing Cone

TASC may need to enforce a number of constraints on the train operations. These include maximal and minimal velocity and acceleration, ranges for the forces in the actuators, etc. A particular set of constraints is the soft-landing cone.

The soft-landing cone for the TASC problem is a set of constraints defining allowed train positions-train velocity combinations that, if always enforced, guarantees that the train will stop in the desired ranges of positions $\epsilon_{tgt}$. The soft-landing cone for TASC problem and the computation of the control invariant set under uncertain train parameters is described in the related Application.

Figure 1:
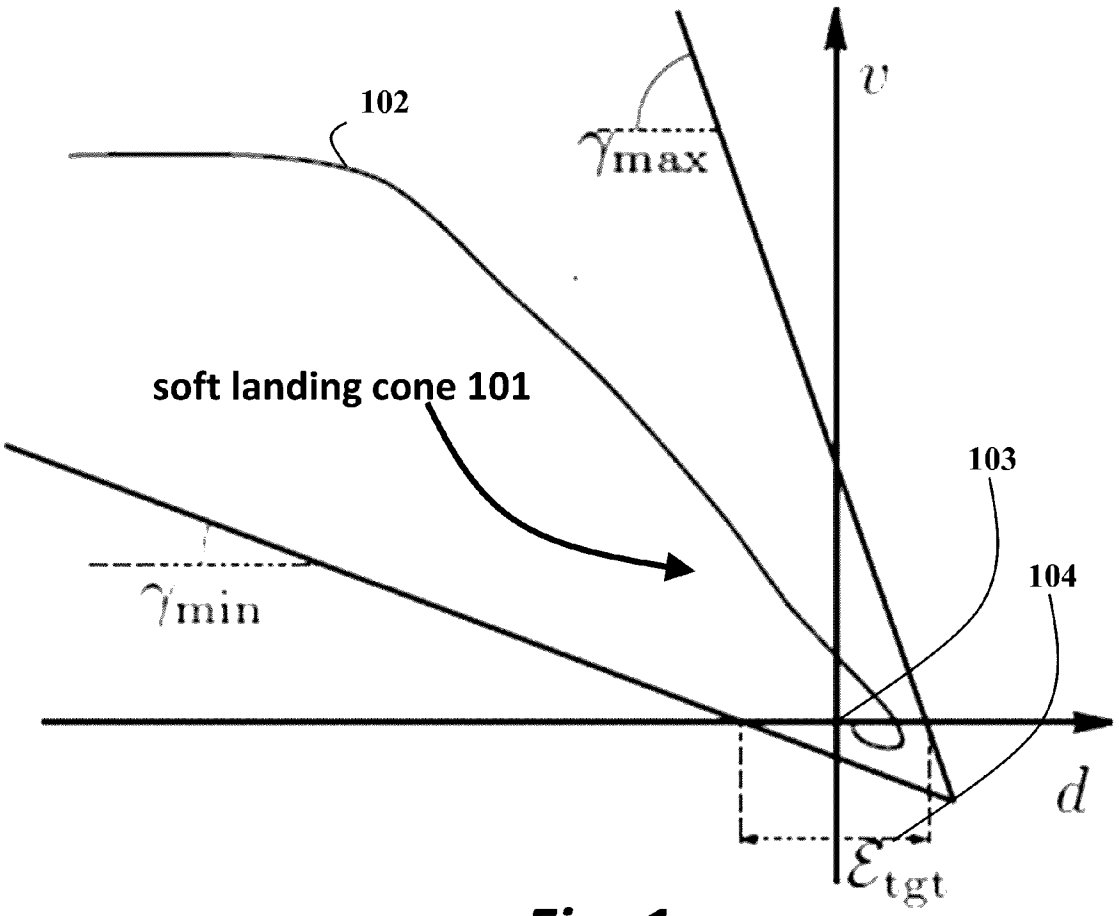
FIG. 1 is a schematic of a trajectory inside a soft-landing cone according to embodiments of the invention.

FIG. 1 shows an example of a trajectory 102 represented by train velocity v and distance d from the center of the desired range 104 of stop positions 103 enforcing the soft landing cone 101. As described in the related Application, from the train operating constraints and soft landing cone an additional set of constraints called a control invariant set is computed. For instance, the control invariant constraints may result into constraints between state and command input of equation (3) in the form $$H_x^{\infty}x+H_u^{\infty}u \leq k^{\infty}. \tag{7}$$

The constraints of the control invariant sets are such that if the constraints are satisfied, the train operating constraints and the soft landing cone constraints are satisfied. Furthermore, TASC can always find a selection of the braking and traction controls that satisfies the control invariant set constraints, hence stopping occurs precisely in the desired range of position. In certain embodiments of this invention the constraints in equation (7) may also include additional constraints on the operation of the train.

Two-Steps Dual Control MPC for Train Automated Stopping Control

FIG. 2 shows a process and structure of the dual control with parameter estimation system and method according to embodiments of the invention. An excitation input sequence reference generator (reference generator) 205 takes as an input a current state x 206 of a train 200, the uncertain model 204 of the train, e.g., the matrices and vectors ($A_i$, $B_i$, $w_i$) in equation (4), and the current estimate 201 of the unknown parameters, e.g., $\hat{\theta}_i$, and $\hat{\eta}_i$, produced by the parameter estimator 213.

The reference generator determines a sequence of excitation inputs ($U_{exc}$) 202. The controller 215 receives the uncertain model 204, the estimate of the unknown parameters 201, the state 206, the constraints 203, for instance in the form described by equation (7). The controller 215 also receives the sequence of excitation inputs 202, a control-oriented cost function 210, and a parameter estimate reliability 212 produced by the parameter estimator 213, and produces a command input u 211 for the train that represents the action to be applied to the traction-brake actuator 220.

The command input 211 is also provided to the parameter estimation 213 that uses the command input, together with the state 206 to compare the expected movement of the train, resulting in an expected future state of the train. The parameter estimator compares the expected future state of the train with the state of the train 206 at a future time to adjust the estimate of the unknown parameters.

Figure 3:
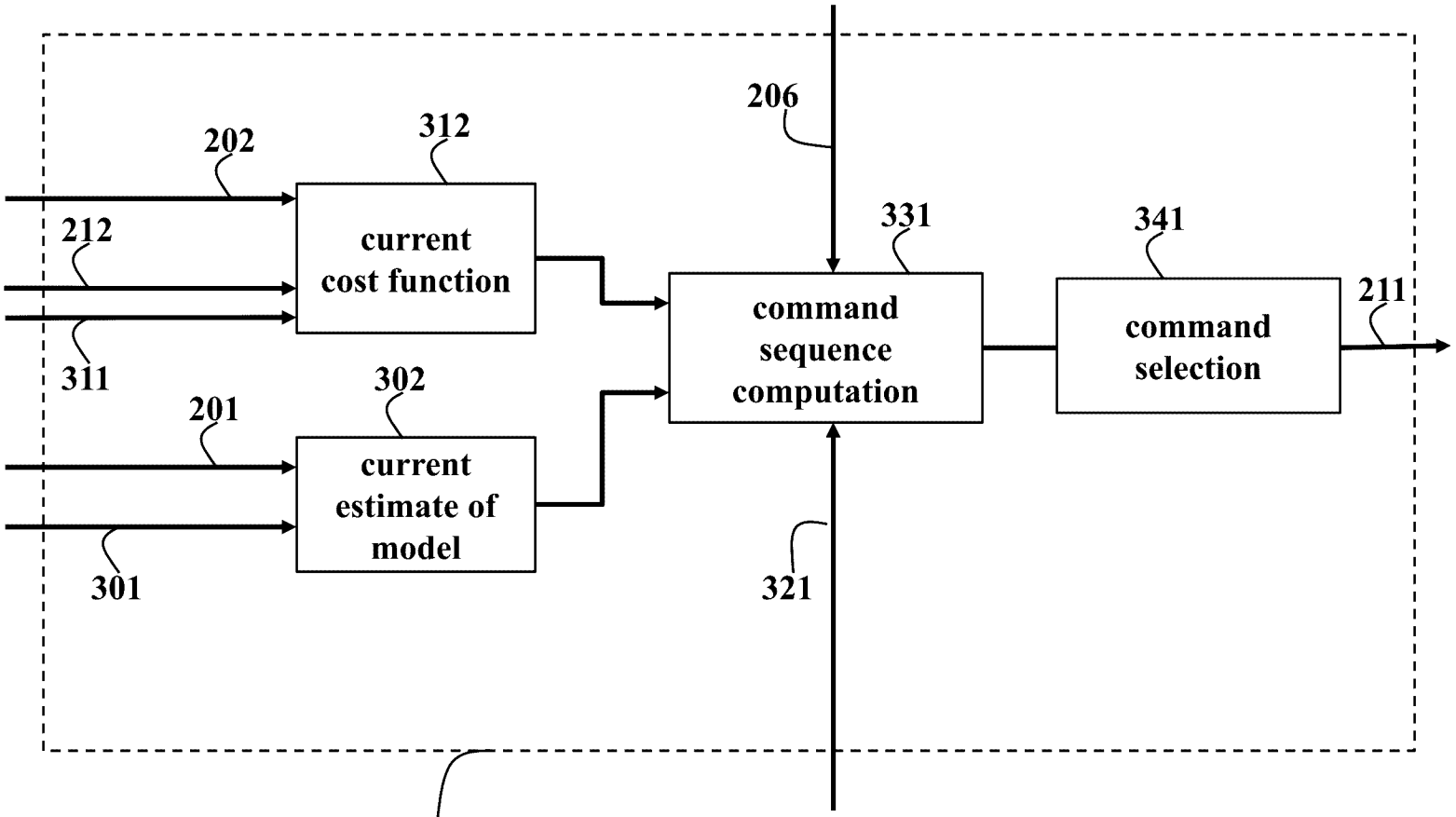
FIG. 3 is a block diagram of a controller according to embodiments of the invention.

FIG. 3 describes the operation of the controller 215. The uncertain model 301 from block 204 in FIG. 2, and the estimate of the unknown parameter 201 are used to determine the current estimate of the train model 302, e.g., as in (5), (6). The provided control-oriented cost function 311 from 210, the provided sequence of excitation 202, and the parameter estimate reliability 212 are used to determine a current cost function 312.

The current estimate of the train model 302, the current cost function 312, the current state 206 and the constraints 321 from 203 are used in the command computation 331 to obtain a sequence of future train command inputs. The command selection 341 selects the first in time element of the future sequence of commands as the train command input 211.

Figure 4:
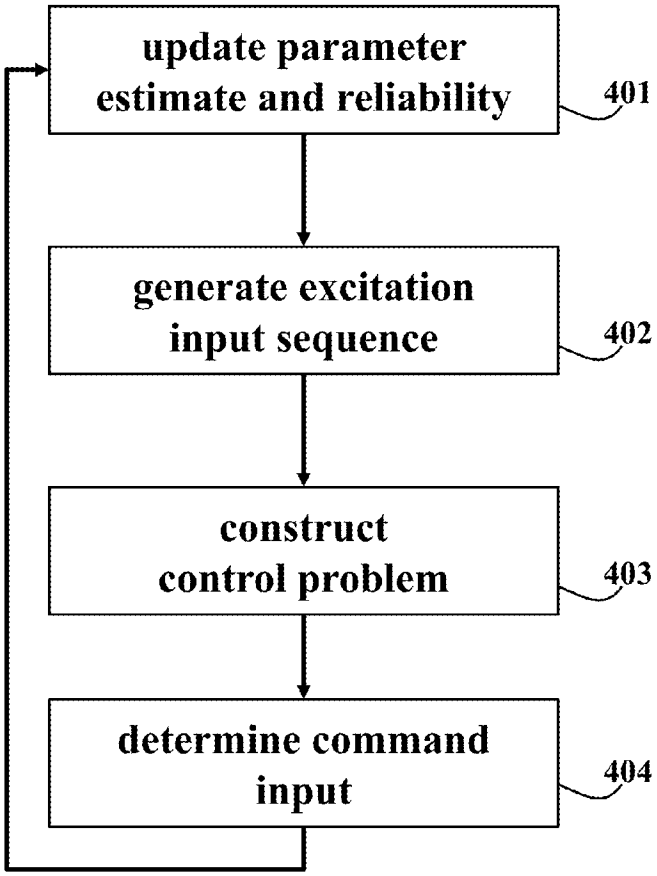
FIG. 4 is a block diagram of the operations of the method and system for stopping a train at a predetermined range of positions according to embodiments of the invention.

FIG. 4 describes the method in terms of sequence of actions performed iteratively.

First, from the state 206 and previously predicted future state, based on past state past parameter estimate and command input 211, the parameter estimate 201 is updated 401, and a parameter estimate reliability 212 is produced.

Then in block 402, using the parameter estimate 201 and the uncertain model 204 a sequence of excitation inputs 202 is generated.

Then in block 403, using the sequence of excitation inputs 202, the uncertain model 204, parameter estimate 201, the parameter estimate reliability state 206, the control-oriented cost function 210, the constraints 203, and the state 206, a control problem is built.

Finally, control problem is solved, and the command input 211 is determined 404 and applied to the traction-brake actuator 220. The cycle is repeated when a new value for the state 206 is available.

The method steps described herein can be performed in a microprocessor, field programmable array, digital signal processor or custom hardware.

Parameter Estimator

Figure 5:
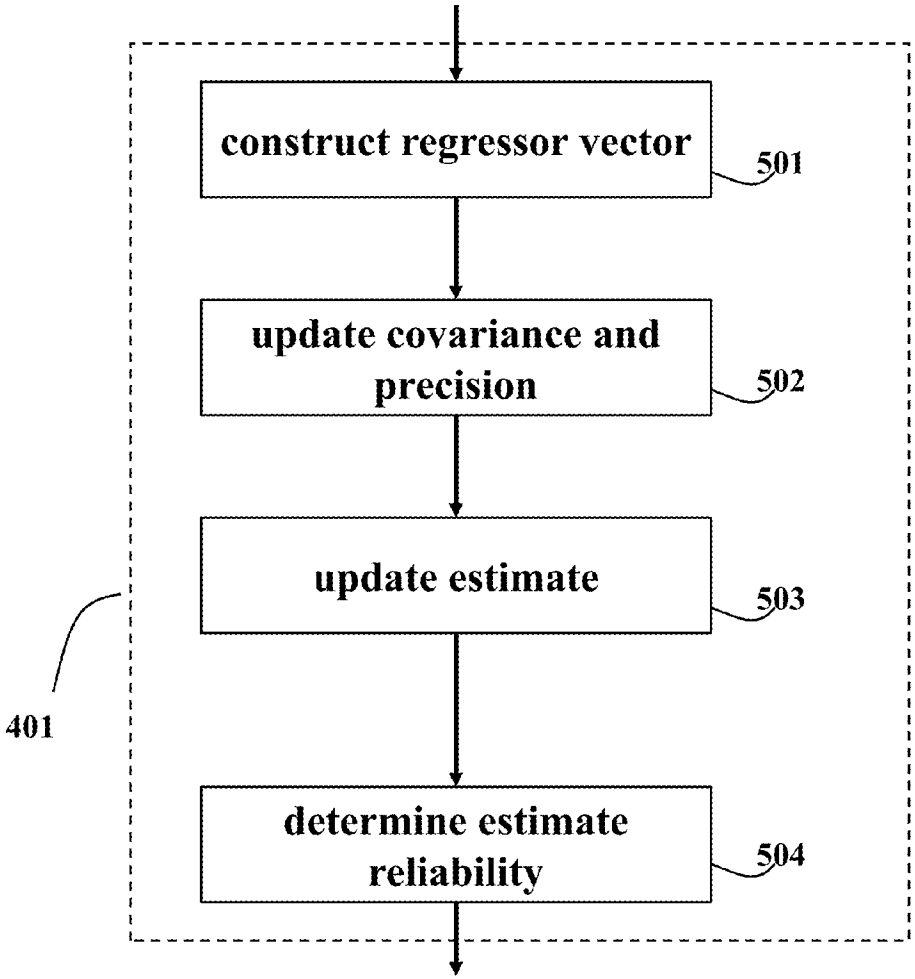
FIG. 5 is a block diagram of the operations of a parameter according to embodiments of the invention.

As shown in FIG. 5, the parameter estimator 401 adjusts the current estimate of the unknown parameters using the most recent data, in order to obtain a system model estimate (6a), (6b). From measurement of the system state (206) and command input (211), we describe for block 501 the system in regressor form $$x(k+1)+\epsilon(k+1)=\sum_{i=1}^{l}[\theta]_i(A_ix(k)+B_iu(k))+\sum_{i=1}^{p}[\eta]_iB_ww_i+\epsilon(k+1)=M^T(k)\vartheta(k+1)+\epsilon(k+1), \tag{8}$$

where k is an index of the time step, the regressor matrix M is $$M_k=[A_1x(k)+B_1u(k),\ldots,A_lx(k)+B_lu(k),B_ww_1,\ldots,B_ww_p]^T \tag{10}$$

$^T$ denotes the transpose, and $\theta(k+1)=[\theta_1(k+1)\ldots\theta_l(k+1)\eta_1(k+1)\ldots\eta_p(k+1)]^T$ is the parameter vector.

Then, we update 502 the estimate of the estimation covariance and precision by $$K(k+1)=P(k)M(k)(\alpha I+M^T(k)P(k)M(k))^{-1} \tag{9}$$

$$P(k+1)=\frac{1}{\alpha}(I-K(k+1)M^T(k))P(k)$$

$$R(k+1)=\alpha R(k)+M(k)M^T(k),$$

where $\alpha$ is a positive filtering constant related to how much the estimate of the unknown parameters should rely on previous estimated values, and it is lower when less reliance on older estimates is desired.

Due to the presence of constraints (6b), a constrained optimization problem is solved to compute the updated estimate of the unknown parameters 503 as $$\hat{\vartheta}(k+1)=\underset{\vartheta}{\operatorname{argmin}}\ \|\nu(k+1)-M^T(k)\vartheta\|^2+\|\hat{\vartheta}(k)-\vartheta\|^2_{\alpha R(k)} \tag{10}$$

$$\text{s.t.}\quad \vartheta=[\theta_1\ldots\theta_l\,\eta_1\ldots\eta_p]^T,\quad \sum_i\theta_i=1,\ \theta_i\geq 0,\quad \sum_i\eta_i=1,\ \eta_i\geq 0$$

where $\hat{\theta}(k+1)=[\hat{\theta}_1(k+1)\ldots\hat{\theta}_l(k+1)\hat{\eta}_1(k+1)\ldots\hat{\eta}_p(k+1)]^T$ is the updated estimate of the unknown parameters.

Together with the estimate of the unknown parameters, a reliability of the estimate $\gamma$ is computed 504 that is a nonnegative value that is smaller the more the estimate of the unknown parameters is considered reliable, where 0 means that the estimate of the unknown parameters is certainly equal to the correct value of the parameters. In some embodiments of this invention, the estimate reliability is computed as $$\gamma(k+1)=\|\nu(k+1)-M^T(k)\hat{\theta}(k+1)\|^2 \tag{11a}$$

or alternatively as $$\gamma(k+1)=det(P(k+1)) \tag{11b}$$

or $$\gamma(k+1)=\text{trace}(P(k+1)) \tag{11c}$$

Excitation Input Sequence Reference Generator

We quantify a reduction of uncertainty due to an input sequence in terms of the predicted persistence of excitation measured through a change in the information matrix minimal eigenvalue over the learning time horizon $\Gamma$ $$\psi(U)=-\lambda_{min}(R_\Gamma-R_0). \tag{12}$$

Equation (12) is used as an optimization objective function in computing the sequence excitation inputs.

The estimates of the unknown parameters converge to their true values when the condition $\Delta_{min}(R_\Gamma-R_0)>0$ is satisfied for a learning time horizon $\Gamma\epsilon Z^+$ where $Z^+$ is the set of positive integers. The information matrix R is $$R_i=\alpha^iR_0+\Sigma_{j=0}^{i-1}\alpha^jM_{i-j-1}M_{i-j-1}^T. \tag{13}$$

The reference generator 205 determines the excitation input 202 by solving $$\max_{U_{exc}(k)}\ \lambda_{min}(R_Y-R_0) \tag{14}$$

$$\begin{aligned}\text{s.t.}\quad & x_{i+1}=\hat{A}_kx_i+\hat{B}_ku_{exc,i}+B_w\hat{w}_k,\\ & R_{i+1}=M_i(x_i,u_{exc,i})M_i^T(x_i,u_{exc,i})+\alpha R_i,\ \forall_{i=0}^{Y-1}\\ & H_x^\infty x_0+H_u^\infty u_{exc,0}\leq K_u^\infty,\\ & R_0=R(k),\end{aligned}$$

where the excitation input sequence is $$U_{exc}(k)=[u_{exc,1}^T,u_{exc,2}^T,\ldots,u_{exc,\Gamma}^T]^T.$$

Considering the train dynamics and the invariant set constraints (14), based on soft landing cone, ensures that the excitation input is feasible.

Because equation (8) is non-convex in U, solving an optimization problem involving (8) directly requires significant amount of computation and may even be impossible during actual train operation.

Thus, it is a realization of this invention that indices of the information matrix $R_{ij}$ can be expressed as quadratic functions of the command input, $$[R]_{ij}=U^TQ_{ij}U+f_{ij}^T+c_{ij}=\text{trace}(Q_{ij}UU^T)+f_{ij}^TU+c_{ij}. \tag{15}$$

It is another realization of this invention that by substituting $UU^T$ in equation (15) with a new variable $\tilde{U}$, and enforcing $$V=\begin{bmatrix}\tilde{U} & U\\ U & 1\end{bmatrix}$$

to be a rank-1 positive semi-definite matrix, thus reformulating equation (14) as $$\begin{aligned}\min_{\tilde{U},U,\rho}\ & -\rho \\ \text{s.t. } & R_d-\rho I\geq 0\\ & [R_d]_{i,j}=Tr(Q_{ij}\tilde{U})+f_{ij}^TU+c_{i,j},\ \forall_{i,j=1}^{l+p}\\ & V=\begin{bmatrix}\tilde{U} & U\\ U^T & 1\end{bmatrix}\geq 0\\ & rank(V)=1\\ & AU-b\leq 0,\end{aligned} \tag{15}$$

where the inequality constraint $AU-b\leq 0$ consolidates constraints $x_{i+1}=\hat{A}_kx_i+\hat{B}_ku_{exc,i}$ and $H_x^\infty x_0+H_u^\infty u_{exc,0}\leq K_u^\infty$ of (14) into a single group of constraints.

In equation (13), the only constraint that makes the problem difficult to solve is the constraint on the rank of the matrix V, which is the rank-1 constraint rank(V)=1, However, it is realized that such constraint can be enforced indirectly by an iterative in inner-loop outer-loop decomposition. In particular, the outer-loop performs a scalar bisection search, and the inner-loop solves a relaxed problem with the constraint on the rank of the matrix by solving a sequence of weighted nuclear norm optimization problems using a current value of a bisection parameter from the outer-loop.

In this method, parameters $\delta_1$, $\delta_2\epsilon R^+$, and $h_{max}\epsilon Z^+$ are used to determine the desired accuracy of the results, i.e., the smaller $\delta_1$, $\delta_2\epsilon R^+$ and the higher accuracy $h_{max}\epsilon Z^+$.

Figure 6:
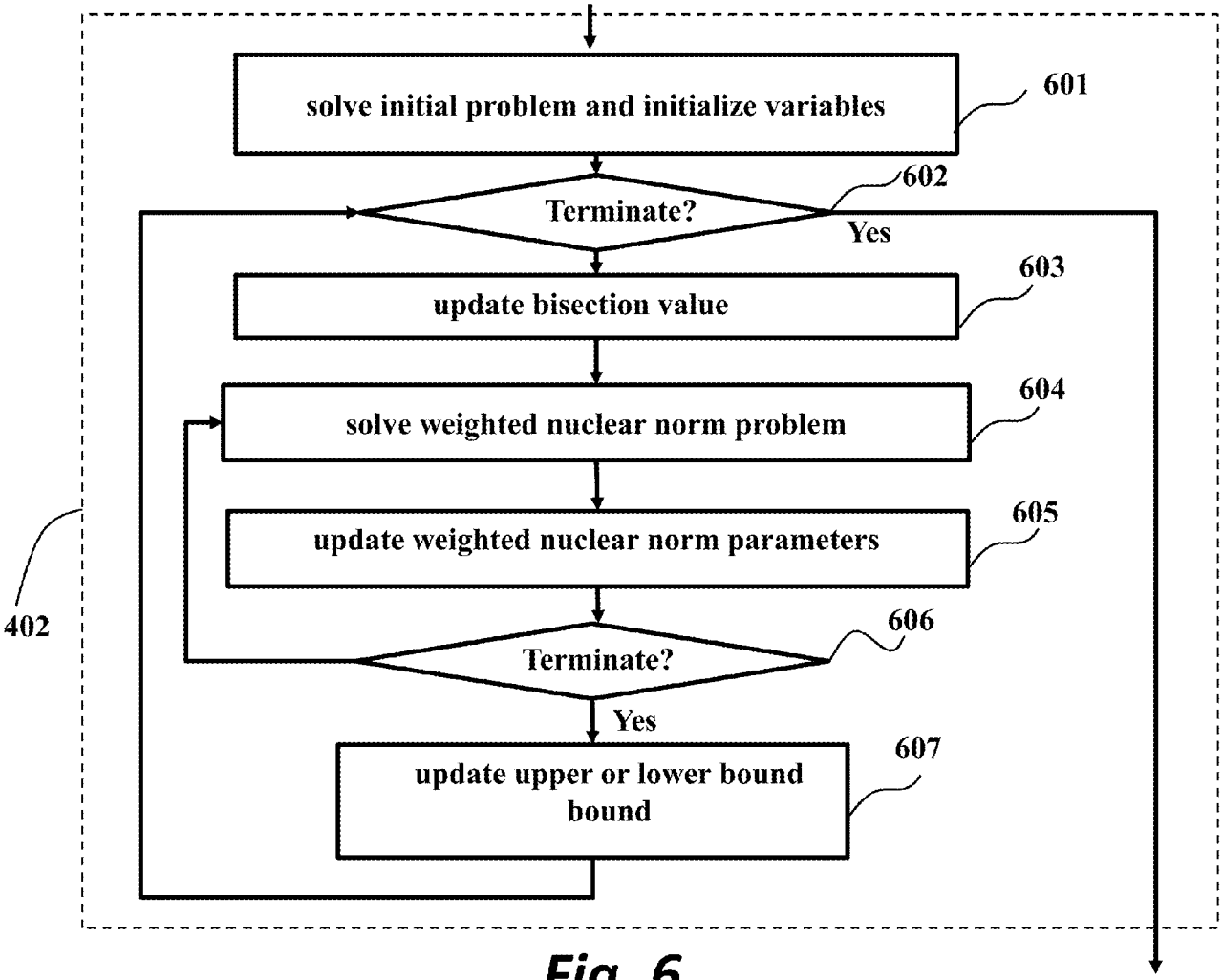
FIG. 6 is a block diagram of the operations of an excitation input sequence reference generator according to embodiments of the invention.

FIG. 6 shows the approach realized in this invention that has the following steps. First, in block 601, solve $$\begin{aligned}\{\tilde{U}^*,U^*,\rho^*\}=\arg\min_{\tilde{U},U,\rho}\ & -\rho,\\ \text{s.t. } & R_d-\rho I\geq 0,\\ & [R_d]_{i,j}=Tr(Q_{ij}\tilde{U})+f_{ij}^TU+c_{ij},\ \forall_{i,j=1}^{l+p}\\ & V=\begin{bmatrix}\tilde{U} & U\\ U^T & 1\end{bmatrix}\geq 0,\\ & AU-b\leq 0,\end{aligned} \tag{16}$$

which is a relaxed version of (15) where the rank-1 constraint is removed.

Based on the solution of (16), we initialize the variables $$\begin{aligned}&[X]_{i,j}=Tr(Q_{ij}U^*U^{*T})+f_{ij}^TU^*+c_{ij},\ \forall_{i,j=1}^{l+p},\\ &\rho_{max}\leftarrow\rho^*,\\ &\rho_{min}\leftarrow\lambda_{min}(X).\end{aligned} \tag{17}$$

Here, $\rho_{min}$ and $\rho_{max}$ represents lower and upper bound on $\lambda_{min}(R_\Gamma-R_0)$. Then, in block 602, if the lower and upper bound of $\lambda_{min}(R_\Gamma-R_0)$ eigenvalue satisfy the termination condition $(\rho_{max}-\rho_{min})/\rho_{max}\leq\delta_1$, we set $U_{exc}=[u_{exc,0}^T\ \ldots\ u_{exc,0}^T]^T=U^*$. Instead if $(\rho_{max}=\rho_{min})/\rho_{max}>\delta_1$ we iterate the following operations.

First in block 603, we update the outer-loop variable ρf and initialize the variables of the inner-loop $$\rho_f\leftarrow 0.5(\rho_{min}+\rho_{max}),W^{(0)}\leftarrow I,h\leftarrow 0, \tag{18}$$

Then, in block 604, we solve $$\begin{aligned}\{\tilde{U}^*,U^*\}=\arg\min_{\tilde{U},U}\ & Tr(W^{(h)}V^{(h)})\\ \text{s.t. } & R_d-\rho_fI\geq 0,\\ & [R_d]_{i,j}=Tr(Q_{ij}\tilde{U})+f_{ij}^TU+c_{ij},\ \forall_{i,j=1}^{l+p}\\ & V^{(h)}=\begin{bmatrix}\tilde{U} & U\\ U^T & 1\end{bmatrix}\geq 0,\\ & AU-b\leq 0,\end{aligned} \tag{19}$$

which is a convex optimization problem consisting with the weighted minimization of the nuclear norm. Based on the solution of (17), in block 605 we update $$\begin{aligned}&W^{(h+1)}\leftarrow(V^{(h)}+\sigma_2(V^{(h)})I)^{-1}\\ &V^{(h)}=\begin{bmatrix}\tilde{U}^* & U^*\\ U^{*T} & 1\end{bmatrix}\\ &h\leftarrow h+1.\end{aligned} \tag{20}$$

We continue solving (19) and updating by (20) until (block 606) either $\sigma_2(V^{(h-1)})\leq\delta_2\sigma_1(V^{(h-1)})$, where $\sigma_i(V)$ denotes the $i^{th}$ singular value of V, or $h=h_{max}$ or (17) is infeasible, which terminates the inner-loop We update in block 607 the upper and lower bounds based on the different cases for the subsequent outer-loop update. In the first case, we have found a rank 1 solution, and we set $\rho_{min}\leftarrow P_f$, while in the second and third case we have not found a solution, and hence we set $\rho_{max}\leftarrow\rho_f$.

Controller

Figure 7:
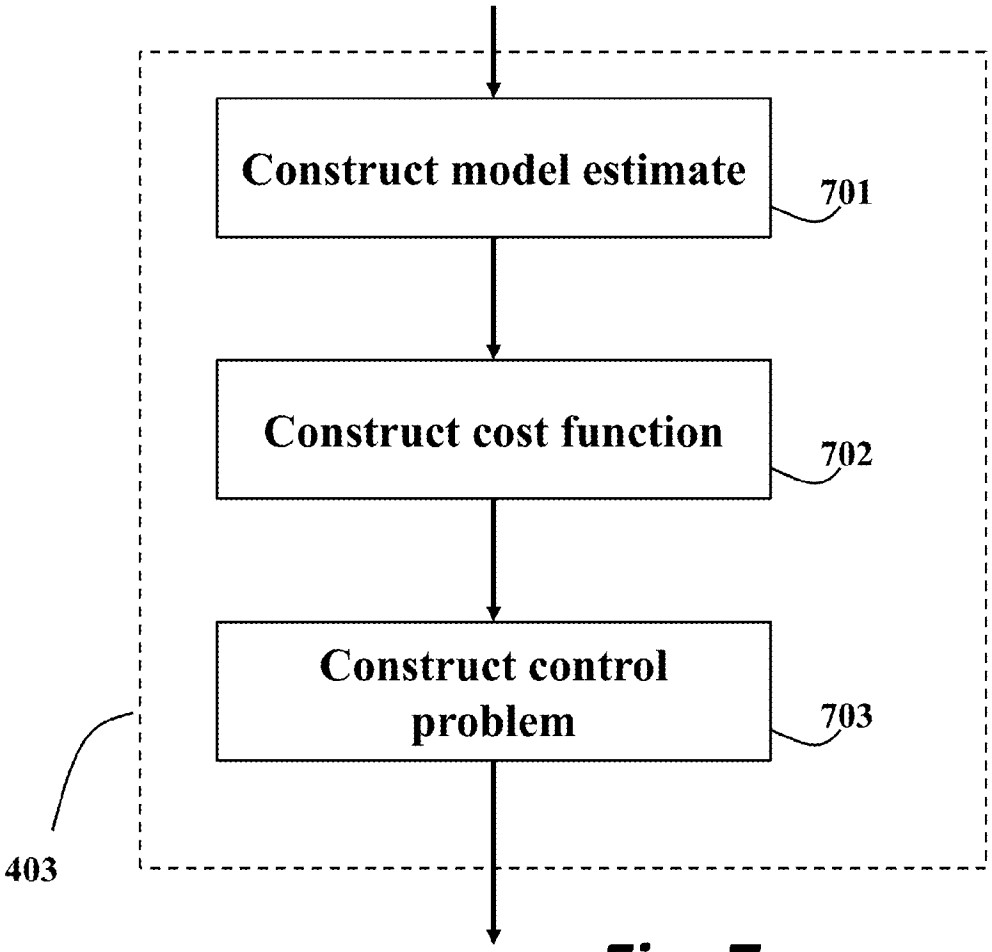
FIG. 7 is a block diagram of the operations of controller function according to embodiments of the invention.

Shown in FIG. 7 is the computation of the command input for the train, where k is the time step index.

First, in block 701 from the current estimate of the unknown parameter obtained from 401 $\hat{\theta}(k)=[\hat{\theta}_1(k)\ \ldots\ \hat{\theta}_l(k)\hat{\eta}_1(k)\ \ldots\ \hat{\eta}_p(k)]^T$ a current estimate of the train dynamics 302 is obtained as $$\begin{aligned}x(k+1)&=\sum_{i=1}^{l}\hat{\theta}_i(k)(A_ix(k)+B_iu(k))+\sum_{i=1}^{p}\hat{\eta}_i(k)B_ww_i\\ &=\hat{A}(k)x(k)+\hat{B}(k)u(k)+B_w\hat{w}(k).\end{aligned} \tag{21}$$

Next, in block 702 from the excitation input sequence $U_{exc}(k)$ computed from 402, from the reliability of the estimate $\gamma(k)$ computed from 401, and from an control-oriented cost function $J_c$ such as $$J_c = x_N^T P_{cost} x_N^T + \sum_{i=0}^{N-1} x_i^T Q_{cost} x_i^T + u_i^T R_{cost} u_i, \tag{22}$$

where $P_{cost}$, $Q_{cost}$, $R_{cost}$ are weighting matrices N is a prediction time horizon and i is the prediction index, a cost function is constructed as $$J(k) = J_c + \gamma(k) \sum_{i=0}^{N-1} (u_i - u_{exc,i})'(u_i - u_{exc,i}), \tag{23}$$

which includes the control-objective $J_c$ and an additional learning-objective of applying a command close to the one obtained by the excitation input sequence reference generator. The learning objective in (23) is to minimize the sum of squared norm of a difference between components of the sequence of excitation inputs and the sequence of command inputs.

Then, from the prediction model 701 and the cost function 702, the constraints 203, and the current state 206 a control problem is constructed 703 as $$\begin{aligned} &\min_U \; J(k) \\ &\text{s.t. } x_{i+1} = \hat{A}(k)x_i + \hat{B}(k)u_i + B_w \hat{w}(k), \\ &\quad H_x^\infty x_i + H_u^\infty u_i \le K_u^\infty, \; \forall_{i=0}^{N-1} \\ &\quad x_0 = x(k), \end{aligned} \tag{24}$$

where $U=[u_0 \ldots u_{N-1}]$, and by solving it numerically, the command input to the train 211 is computed as u(k)=no.

Due to the particular construction developed in this paper, when the control-oriented cost function $J_c$ is quadratic as in (22), the solution of (24) can be obtained by solving a procedure for constrained quadratic programming, because the constraints in equation (7) are linear constraints, (21) is linear, and the term added to $J_c$ in equation (23) is quadratic.

Different embodiments of the invented dual control method can use different parameter estimators 220. One embodiment can be based on the recursive least squares (RLS) filters, or on constrained RLS filters.

Although the invention has been described by way of examples of preferred embodiments, it is to be understood that various other adaptations and modifications may be made within the spirit and scope of the invention. Therefore, it is the object of the appended claims to cover all such variations and modifications as come within the true spirit and scope of the invention.

We claim:

1. A control system for controlling a traction-braking system with actuators configured to actuate for exerting a force for stopping a train at a range of predetermined positions, comprising:

a computer readable memory in communication with a computer to store predictive measurement data of the train, current measurement data of the train and executing computer executable instructions; and a processor of the computer is configured to implement:

measuring a state of the train;

a parameter estimator algorithm configured to update parameter estimates of unknown parameters and a reliability of the estimate of the unknown parameters, based on a comparison of a predicted state of the train with the measured state of the train, by adjusting matrices related to data acquired from the train, and computing a value of parameters within a predetermined set of parameter values, that results in predicted data having a least difference with recent current measured data of the train;

an excitation input sequence reference generator, wherein the excitation reference input sequence generator is configured to acquire dynamics of the train, and where the excitation input sequence reference generator determines a sequence of excitation inputs based on a current estimate of system parameters, the measured state of the train, and a set of constraints on an operation of the train, that results in obtaining a greater difference between current and future matrices related to the data acquired from the train, among a set of allowed sequences of excitation inputs; and a model predictive control (MPC) configured to receive a control-oriented cost function, a set of constraints, the sequence of excitation inputs, the estimate of the unknown parameters and the reliability of the estimate of the unknown parameters to determine an input command for a traction-brake actuator of the actuators of the braking system of the train.

2. The system of claim 1, wherein the parameter estimator estimates the unknown parameters that are coefficients of convex combinations of a set of known linear models that represent all possible values of the dynamics of the train.

3. The system of claim 1, wherein the parameter estimator determines a reliability of the parameter estimates.

4. The system of claim 1, wherein the reliability of the parameter estimates is determined from a difference between the measured state of the train and the predicted state of the train according to the parameter estimates.

5. The system of claim 1, where the reliability of the estimate of the unknown parameters is determined from a function of an expected covariance of an estimation error according to the parameter estimates.

6. The system of claim 1, wherein the sequence of excitation inputs is determined by increasing a measure of a system information matrix.

7. The system of claim 6, wherein further comprising:

determining the sequence of excitation input by maximizing a minimal eigenvalue of the system information matrix.

8. The system of claim 7, wherein the maximizing of the minimal eigenvalue of the system information matrix is solved by solving a convex optimization problem with a constraint on a rank of the system information matrix in the convex optimization problem.

9. The system of claim 7, wherein the excitation input sequence reference generator solves the convex optimization problem with a constraint on a rank of the system information matrix in the convex optimization problem using an iterative inner-loop outer-loop decomposition, where the outer-loop performs a scalar bisection search, and the inner-loop solves a relaxed problem with a constraint on the rank of the system information matrix by solving a sequence of weighted nuclear norm optimization problems using a current value of a bisection parameter from the outer-loop.

10. The system of claim 1, wherein the MPC constructs a control problem along a future time horizon from an estimate of the dynamics of the train using the parameter estimates, a cost function constructed from a control-oriented cost function, and a learning-oriented term weighted by a reliability of the parameter estimates, and determines the input command from a solution of the control problem.

11. The system of claim 10, wherein the learning-oriented term is a function of the sequence of excitation inputs.

12. The system of claim 11, wherein the function of the sequence of excitation is a sum of squared norm of a difference between components of the sequence of excitation inputs and a sequence of the command inputs.

13. The system of claim 1, wherein the difference between current and future matrices related to the data acquired from the train is determined by an increase of a measure of a system information matrix.

14. The system of claim 1, wherein the force for stopping the train at the range of predetermined positions is a combination of one of a traction force and a braking force or a braking force.

15. A method for controlling a traction-braking system with actuators configured to actuate for exerting a force for stopping a train at a range of predetermined positions, comprising steps:

employing, a computer readable memory in communication with a computer to store predictive measurement data of the train, current measurement data of the train and executing computer executable instructions; and a processor of the computer is configured to implement:

acquiring a measured state of the trains;

updating, in a parameter estimator algorithm, estimates of unknown parameters and a reliability of the estimate of the unknown parameters, based on a comparison of a predicted state of the train with the measured state of the train, by adjusting matrices related to data acquired from the train, and computing a value of parameters within a predetermined set of parameter values, that results in predicted data having a least difference with recent current measured data of the train;

acquiring, in an excitation input sequence reference generator, dynamics of the train to determine a sequence of excitation inputs based on a current estimate of system parameters, the measured state of the train, and a set of constraints on an operation of the train, such that the excitation input sequence reference generator results in obtaining a greater difference between current and future matrices related to the data acquired from the train, among a set of allowed sequences of excitation inputs; and receiving, in a model predictive controller (MPC), a control-oriented cost function, a set of constraints, the sequence of excitation inputs, the estimate of the unknown parameters and the reliability of the estimate of the unknown parameters to determine an input command for at least one traction-brake actuator of the actuators of the braking system of the train.

* * * * *